US005413048A

United States Patent [19]

Werner et al.

[11] Patent Number: 5,413,048

[45] Date of Patent: * May 9, 1995

[54] SHAPED CHARGE LINER INCLUDING BISMUTH

[75] Inventors: Andrew T. Werner, East Bernard; James G. Rider, Missouri City, both of Tex.

[73] Assignee: Schlumberger Technology Corporation, Houston, Tex.

[ * ] Notice: The portion of the term of this patent subsequent to Jun. 22, 2010 has been disclaimed.

[21] Appl. No.: 80,430

[22] Filed: Jun. 17, 1993

Related U.S. Application Data

[63] Continuation-in-part of Ser. No. 778,434, Oct. 16, 1991, Pat. No. 5,221,808.

[51] Int. Cl.[6] ..... F42B 1/02

[52] U.S. Cl. ..... 102/307; 102/476; 199/14

[58] Field of Search ..... 102/307, 476; 147/14, 147/15

[56] References Cited

U.S. PATENT DOCUMENTS

| | | | |
|---|---|---|---|
| 3,675,575 | 4/1972 | Bailey et al. | 102/24 HC |
| 4,005,660 | 2/1977 | Pichard | 102/92.1 |
| 4,557,771 | 12/1985 | Benez et al. | 149/14 |
| 4,613,370 | 9/1986 | Held et al. | 75/248 |
| 4,724,767 | 2/1988 | Aseltine | 102/307 |
| 4,766,813 | 8/1988 | Winter et al. | 102/307 |
| 4,803,019 | 2/1989 | Graham et al. | 264/3.1 |
| 4,811,666 | 3/1989 | Lutfy | 102/501 |
| 4,867,061 | 9/1989 | Stadler et al. | 102/307 |
| 4,958,569 | 9/1990 | Mandigo | 102/476 |
| 5,098,487 | 3/1992 | Brauer et al. | 148/432 |
| 5,119,729 | 6/1992 | Nguyen | 102/307 |
| 5,127,332 | 7/1992 | Corzine et al. | 102/509 |
| 5,159,146 | 10/1992 | Carisella et al. | 89/1.15 |
| 5,221,808 | 6/1993 | Werner et al. | 102/307 |
| 5,223,665 | 6/1993 | Burleson et al. | 102/312 |

OTHER PUBLICATIONS

Rose et al., *Condensed Chemical Dictionary,* Van Nostrand Reinhold Co., N.Y., N.Y., (1966), pp. 121–122.

*Primary Examiner*—Peter A. Nelson

*Attorney, Agent, or Firm*—Henry N. Garrana; John H. Bouchard

[57] ABSTRACT

A shaped charge includes a case, an explosive material packed against the inner wall of the case, and a liner for lining the explosive material, where the liner includes Bismuth and Copper powders as constituent elements. The Bismuth element replaces a Lead element which is normally present as a constituent element in prior art shaped charge liners. Bismuth is superior to Lead because all environmental concerns, with respect to the deposition of Lead in a formation, have been eliminated.

29 Claims, 1 Drawing Sheet

SHAPED CHARGE LINER INCLUDING BISMUTH

This is a continuation-in-part of application Ser. No. 07/778,434, filed Oct. 16, 1991, now U.S. Pat. No. 5,221,808.

BACKGROUND OF THE INVENTION

The subject matter of the present invention relates to shaped charges, and more particularly, to a liner of a shaped charge which is comprised of Bismuth and Copper powders instead of Lead and Copper powders.

Shaped charges, which may, for example, be used in a perforating gun for perforating a wellbore, include a case, an explosive material packed against the inner wall of the case, and a liner for lining the explosive material. Upon detonation, the explosive material expands thereby collapsing the liner and forming a jet. When used in a perforating gun, the jet from the shaped charge perforates a formation traversed by the wellbore. The liner of the shaped charge is normally made of Lead and Copper. When the liner collapses and forms the jet, the lead and Copper elements in the liner are deposited in the formation. From an environmental point of view, it is not desirable to deposit Lead in the formation. Therefore, a new shaped charge is needed, one which includes a liner that does not incorporate Lead as one of its constituent elements.

SUMMARY OF THE INVENTION

Accordingly, it is a primary object of the present invention to provide a shaped charge, which may be adapted for use in a perforating gun, that produces a jet which, from an environmental point of view, is clearly superior to any other known lead based shaped charge of the prior art.

It is a further object of the present invention to provide a shaped charge that includes a liner which does not incorporate Lead as one of its constituent elements.

It is a further object of the present invention to provide a shaped charge that includes a liner which incorporates Bismuth as a constituent element instead of Lead.

These and other objects of the present invention are accomplished by designing and providing a shaped charge which includes a case, an explosive material packed against the inner wall of the case, and a liner for lining the explosive material, the liner including Bismuth and any metal powder or metal alloy powder having a particle density of over 6 grams/cm$^3$ as constituent elements. For example, the metal powder or metal alloy powder having a particle density of over 6 grams/cm$^3$ would include the following: Copper, Nickel, Zinc, Iron, Tin, Tungsten, Tantalum, Bronze, and depleted Uranium. The Bismuth element replaces a Lead element which is normally present as a constituent element in prior art shaped charge liners. Although it is undesirable, from an environmental point of view, to deposit Lead in a formation traversed by a wellbore when a shaped charge of a perforating gun is detonated, there is no such environmental concern with regard to the deposition of Bismuth in the formation. In fact, the use of Bismuth instead of Lead as a constituent element in a shaped charge completely solves and eliminates the environmental concern as an issue.

Further scope of applicability of the present invention will become apparent from the detailed description presented hereinafter. It should be understood, however, that the detailed description and the specific examples, while representing a preferred embodiment of the present invention, are given by way of illustration only, since various changes and modifications within the spirit and scope of the invention will become obvious to one skilled in the art from a reading of the following detailed description.

BRIEF DESCRIPTION OF THE DRAWINGS

A full understanding of the present invention will be obtained from the detailed description of the preferred embodiment presented hereinbelow, and the accompanying drawings, which are given by way of illustration only and are not intended to be limitative of the present invention, and wherein.

DETAILED DESCRIPTION OF THE PREFERRED EMBODIMENT

Figure 1:
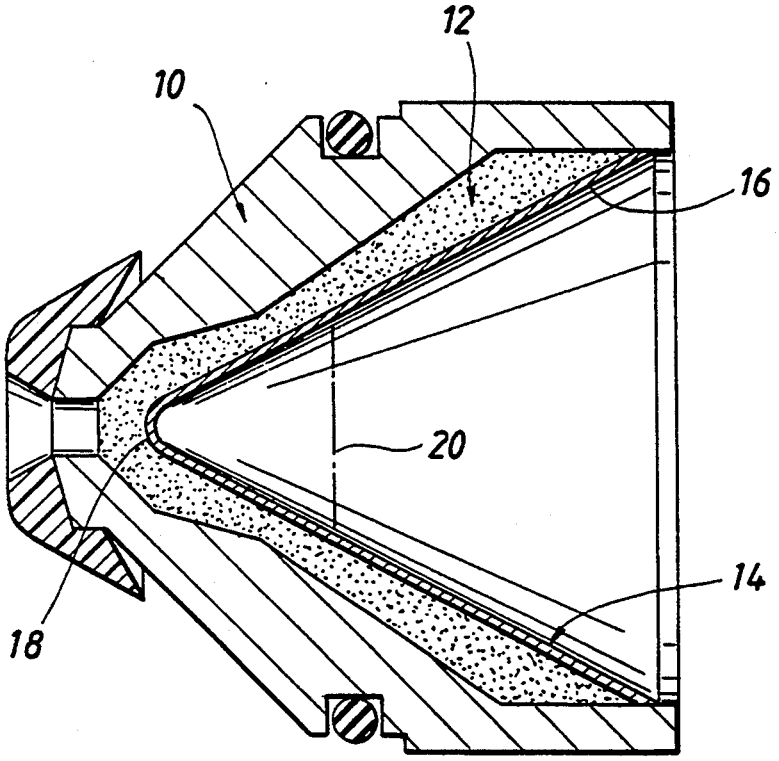
FIG. 1 illustrates a typical shaped charge having a case, an explosive material, and a liner, where the liner is comprised of Bismuth powder and any metal powder or metal alloy powder having a particle density of over 6 grams/cm$^3$, and does not include lead.

Referring to FIG. 1, a typical shaped charge adapted for use in a perforating gun is illustrated. This particular shaped charge is discussed in U.S. Pat. No. 4,724,767 to Aseltine, issued Feb. 16, 1988, the disclosure of which is incorporated by reference into this specification.

In FIG. 1, the shaped charge includes a case 10, an explosive material 12, such as RDX, packed against the inner wall of case 10, and a liner 14 lining the explosive material 12. When a detonating cord ignites the explosive material 12, the liner 14 collapses thereby forming a jet. The jet propagates outwardly along a longitudinal axis of the shaped charge. When the shaped charge is disposed in a perforating gun which is situated in a wellbore, the jet from the shaped charge perforates a formation traversed by the wellbore.

Normally, the liner of a prior art shaped charge is comprised of Lead and Copper powders. When the liner collapses thereby forming a jet, the Lead and Copper elements are deposited into the formation. From an environmental point of view, it is not desirable to deposit Lead in the formation. Therefore, a new shaped charge liner is needed which does not include Lead as a constituent element.

In accordance with the present invention, the Lead element, present as a constituent element within the liner of the prior art shaped charge, is being replaced by the element Bismuth. Accordingly, in FIG. 1, the shaped charge liner 14, in accordance with the present invention, is comprised of Bismuth powder and any metal powder or metal alloy powder having a particle density of over 6 grams/cm$^3$; the liner 14 does not include lead. For example, the metal powder or metal alloy powder having the particle density of over 6 grams/cm$^3$ would include one of or a blend of the following: copper, iron, tin, tungsten, tantalum, zinc, bronze, or depleted uranium. By way of example, shooting tests indicate that a shaped charge having a liner 14 comprised of ten percent (10%) by weight of Bismuth, as a binder, and ninety percent (90%) by weight of a three-Copper blend can shoot as well as the standard shaped charge having a liner which is normally comprised of twenty percent (20%) Lead and eighty percent (80%) Copper. Alternatively, shooting tests also indicate that a shaped charge having a liner 14 comprised of twenty percent (20%) by weight of Bismuth, as a binder, and eighty percent (80%) by weight of a three-Copper blend can shoot as well as the standard shaped charge having a liner which is comprised of the standard Lead and Copper. Less than ten percent (10%) Bismuth does not yield the required performance; and greater than twenty percent (20%) Bismuth is too costly. Therefore, any shaped charge including a liner 14 having a composition in the range from 10% Bismuth powder/90% metal powder or metal alloy powder having the particle density of over 6 grams/cm$^3$ to 20% Bismuth powder/80% metal powder or metal alloy powder having the particle density of over 6 grams/cm$^3$ will perform well if properly optimized.

Bismuth was chosen for a number of reasons. Bismuth is non-toxic, melts at 519.8 degrees F., and boils at 2840 degrees F. Its specific gravity is 9.75 (Lead is 11.34), and Bismuth is one of the least expensive of the "heavy" metals. In addition, it is believed that the presence of an easily vaporized component (such as Lead or Bismuth) in a liner 14 of a shaped charge is important because the radially dispersed metallic vapor, produced from the Lead or Bismuth element, tends to impart inward momentum to the balance of the jet being produced from the collapsed liner 14, keeping it focused and aligned. Therefore, since Bismuth has a low boiling point and a low heat of vaporization, similar to Lead, Bismuth was chosen as an adequate substitute for the Lead element in the liner 14 of the shaped charge of FIG. 1. In addition, Bismuth, like Lead, has virtually no solid solubility in Copper. Like lead, Bismuth powder is easily deformed at low stresses and therefore can mechanically bind the metal powder particles or metal alloy powder particles (having the particle density of over 6 grams/cm$^3$) to one another without interdiffusion or alloying, yielding good green strength and ensuring a jet of particulate particles rather than a solid jet.

In FIG. 1, the liner 14 of the shaped charge, in accordance with a preferred embodiment of the present invention, comprised of: (1) Bismuth powder, as a binder; the percent by weight of the Bismuth powder in liner 14 lies in a range from greater than or equal to ten percent (10%) to less than or equal to twenty percent (20%); and (2) a blend of three Copper powders, each including particles having a different particle shape, that is, a three-Copper, three particle morphology blend. The exact amounts and percentages of each constituent element of Bismuth and Copper, incorporated in the liner 14 of the shaped charge of FIG. 1, are disclosed below in the following working examples. Bear in mind, however, that, instead of the blend of three Copper powders referenced above, any metal powder or metal alloy powder having a particle density of over 6 grams/cm$^3$ and suitable particle shape could be used instead of the Copper powder and the shaped charge liner 14 would still perform well; for example, the following metal powders/metal alloy powders could be used instead of Copper powder: nickel, iron, tin, tungsten, tantalum, zinc, bronze, and depleted uranium.

EXAMPLE 1

To make an improved liner 14 for a shaped charge, in accordance with the present invention, which would normally include Lead and Copper, replace the Lead element with a preferred embodiment of Bismuth. Start by making a 1 pound blend of the Bismuth and Copper, which 1 pound blend is comprised of:

(1) 20% by weight, or 90.80 gms, of Bismuth powder; the Bismuth powder must include particles which have an irregular particle shape produced by grinding;

(2) 80% by weight, or 363.20 gins total, of a blend which consists of three Copper powders, each Copper powder including particles having a different particle shape. The blend of three Copper powders is comprised of the following:

(a) 64% by weight, or 290.56 gms, Copper powder including gas or water atomized particles having roughly spherical shape; this powder may be obtainable from the Canadian Metal Powders Corporation;

(b) 12% by weight, or 54.48 gms, Copper powder including electrochemically reduced copper having irregular particle shape; this powder is obtainable from the U.S. Bronze Corporation, Flemington, N.J.; ask for grade R278; and (c) 4% by weight, or 18.16 gms, Copper powder including electrolytically deposited copper having dendritic particle shape; this powder is obtainable from U.S. Bronze Corporation, Flemington, N.J.; ask for grade D101;

(3) the normal amount of graphite and lubricant, which consists of 30.83 ml alcohol, 0.05 gms stearic acid, and 1.362 gms graphite. In fact, one could use the normal amount of graphite plus a lubricant and/or an anti-oxidant.

This blend, when tested according to ASTM B331-85 and ASTM B312-82 will have a Green density of at least 8.0 g/cc and a Green strength of at least 1800 psi.

In FIG. 1, the liner 14 includes a skirt 16 and an apex 18. A taper exists in the thickness of the liner 14, starting with the apex 18 and ending with the skirt 16. Imagine a circle 20 which traverses the circumference of the liner 14; the thickness variation of the liner 14 around the circle 20 is identified as "delta T". Therefore, the objective is to make a shaped charge liner, similar to liner 14 of FIG. 1, having the following specifications:

weight: 32 to 36 grams
delta T: plus or minus 0.0007 inches
thickness of the skirt 16: 0.060 to 0.069 inches
taper: 0.0116 inches at apex to 0.0124 inches at skirt Given the above referenced composition of the liner 14 and the above specifications, a liner 14 was made, a shaped charge was made using the liner 14, and the following results were obtained when a perforating gun was made which included the new shaped charge having the new liner 14 and the perforating gun perforated a formation traversed by a cased wellbore:

Using a concrete target which hardened 3 days after being initially poured, the following test results were obtained, where "penetration" describes the radial depth of penetration of the target, in inches, produced by the jet of the new shaped charge liner 14 of the present invention, and "casing hole dimensions" describes the shape of the hole produced by the jet in a steel casing. The shape of the hole in the casing is further described by the following legend: A×B, where A is the length of the major axis of an elipse or circle in inches, and B is the length of the minor axis of the elipse or circle in inches.

| penetration of formation | casing hole dimensions indicative of circular shape |
|---|---|
| a. 21.50 inches | 0.48 × 0.48 (a perfect circle) |
| b. 23.25 inches | 0.49 × 0.47 (imperfect circle) |

-continued

| penetration of formation | casing hole dimensions indicative of circular shape |
|---|---|
| c. 20.38 inches | 0.50 × 0.49 (imperfect circle) |
| d. 22.50 inches | 0.47 × 0.45 (imperfect circle) |

The above test results indicate that the liner 14 of a shaped charge, in accordance with the present invention, made with Bismuth and Copper, performs just as well, if not better, than a prior art liner made with Lead and Copper; that is, the depth of penetration of the target by the liner 14 of the present invention is just is good, if not better, than the depth of penetration of the formation normally produced by the prior art shaped charge liner, and the entrance hole size and eccentricity are at least as good.

EXAMPLE 2

Start by making a 1 pound blend of the Bismuth and Copper, which 1 pound blend is comprised of:

(1) 10% by weight, or 45.40 gms, of Bismuth powder; the Bismuth powder must include particles which have an irregular particle shape produced by grinding;

(2) 90% by weight, or 408.60 gms total, of a blend which consists of three Copper powders, each Copper powder including particles having a different particle shape. The blend of three Copper powders is comprised of the following:

(a) 72% by weight, or 326.88 gms, Copper powder including gas or water atomized particles having roughly spherical shape; this powder may be obtainable from the Alcan Metal Powders Division of the Alcan Aluminum Corporation, Elizabeth, N.J.

(b) 13.5% by weight, or 61.29 gms, Copper powder including electrochemically reduced copper having irregular particle shape; this powder is obtainable from the U.S. Bronze Corporation, Flemington, N.J.; ask for grade R278; and (c) 4.5% by weight, or 20.43 gms, Copper powder including electrolytically deposited copper having dendritic particle shape; this powder is obtainable from U.S. Bronze Corporation, Flemington, N.J.; ask for grade D101;

(3) the normal amount of graphite and lubricant, which consists of 30.83 ml alcohol, 0.45 gms stearic acid, and 1.362 gms graphite.

Using a concrete target which hardened 3 days after being initially poured, the following test results were obtained, where "penetration" describes the radial depth of penetration of the target, in inches, produced by the jet of the new shaped charge liner 14 of the present invention, and "casing hole dimensions" describes the shape of the hole produced by the jet in a steel casing. The shape of the hole in the casing is further described by the following legend: A×B, where A is the length of the major axis of an elipse or circle in inches, and B is the length of the minor axis of the elipse or circle in inches.

| penetration of formation | casing hole dimensions indicative of circular shape |
|---|---|
| a. 17.38 inches | 0.46 × 0.44 (imperfect circle) |
| b. 17.75 inches | 0.43 × 0.41 (imperfect circle) |

-continued

| penetration of formation | casing hole dimensions indicative of circular shape |
|---|---|
| c. 20.50 inches | 0.47 × 0.47 (a perfect circle) |

The above test results again indicate that the liner 14 of a shaped charge, in accordance with the present invention, made with Bismuth and Copper, performs just as well, if not better, than a prior art liner made with Lead and Copper; that is, the depth of penetration of the formation by the liner 14 of the present invention is just is good, if not better, than the depth of penetration of the formation normally produced by the prior art shaped charge liner.

In summary, the liner 14 of the shaped charge in accordance with the present invention comprises Bismuth powder (which replaces the lead powder) and any metal powder or metal alloy powder having a particle density of over 6 grams/cm$^3$. In accordance with a preferred embodiment of the present invention, the metal powder should preferably be Copper powder. However, the metal powder or metal alloy powder (having the particle density of over 6 grams/cm$^3$) could also be one of or a blend of nickel, iron, tin, tungsten, tantalum, zinc, bronze, or depleted uranium. The percent by weight of the Bismuth powder in liner 14 lies in a range from greater than or equal to 10% to less than or equal to 20%. The remaining ingredients are primarily any metal powder or metal alloy powder having a particle density of over 6 grams/cm$^3$, such as Copper powders; however, the normal amounts of graphite plus a lubricant and/or an anti-oxident are also included.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A liner adapted for use in a charge, comprising:
Bismuth powder; and
a metal powder having a particle density of over 6 grams/cubic centimeter, said metal powder including nickel powder.

2. A liner adapted for use in a charge, comprising:
Bismuth powder; and
a metal powder having a particle density of over 6 grams/cubic centimeter, said metal powder including iron powder.

3. A liner adapted for use in a charge, comprising:
Bismuth powder; and
a metal powder having a particle density of over 6 grams/cubic centimeter, said metal powder including tungsten powder.

4. A liner adapted for use in a charge, comprising:
Bismuth powder; and
a metal powder having a particle density of over 6 grams/cubic centimeter, said metal powder including tantalum powder.

5. A liner adapted for use in a charge, comprising:
Bismuth powder; and
a metal powder having a particle density of over 6 grams/cubic centimeter, said metal powder including zinc powder.

6. A liner adapted for use in a charge, comprising:
Bismuth powder; and a metal powder having a particle density of over 6 grams/cubic centimeter, said metal powder including depleted uranium powder.

7. A liner adapted for use in a charge, comprising:

Bismuth powder; and a metal powder having a particle density of over 6 grams/cubic centimeter, said metal powder including bronze powder.

8. A liner adapted for use in a charge, comprising:

Bismuth powder; and a metal powder having a particle density of over 6 grams/cubic centimeter, said Bismuth powder having a percent by weight, the percent by weight of the Bismuth powder being greater than or equal to ten percent and less than or equal to twenty percent.

9. The liner of claim 8, wherein said metal powder has a percent by weight, the percent by weight of said metal powder being greater than or equal to eighty percent and less than or equal to ninety percent.

10. The liner of claim 9, wherein said metal powder comprises bronze powder.

11. The liner of claim 9, wherein said metal powder comprises depleted uranium powder.

12. The liner of claim 9, wherein said metal powder comprises zinc powder.

13. The liner of claim 9, wherein said metal powder comprises tantalum powder.

14. The liner of claim 9, wherein said metal powder comprises tungsten powder.

15. The liner of claim 9, wherein said metal powder comprises tin powder.

16. The liner of claim 9, wherein said metal powder comprises iron powder.

17. The liner of claim 9, wherein said metal powder comprises nickel powder.

18. A liner adapted for use in a charge, comprising:

Bismuth powder; and another powder, said another powder including nickel powder.

19. A liner adapted for use in a charge, comprising:

Bismuth powder; and another powder, said another powder including iron powder.

20. A liner adapted for use in a charge, comprising:

Bismuth powder; and another powder, said another powder including tungsten powder.

21. A liner adapted for use in a charge, comprising:

Bismuth powder; and another powder, said another powder including tantalum powder.

22. A liner adapted for use in a charge, comprising:

Bismuth powder; and another powder, said another powder including zinc powder.

23. A liner adapted for use in a charge, comprising:

Bismuth powder; and another powder, said another powder including depleted uranium powder.

24. A liner adapted for use in a charge, comprising:

Bismuth powder; and another powder, said another powder including bronze powder.

25. A method of making a liner adapted for use in a charge, comprising the steps of:

blending Bismuth powder with another metal powder thereby producing a result, said another metal powder including a metal powder or a metal alloy powder having a particle density of over 6 grams per cubic centimeter, said Bismuth powder having a percent by weight, the percent by weight of the Bismuth powder being greater than or equal to ten percent and less than or equal to twenty percent; and forming the result into a liner adapted for use in a charge.

26. The method of claim 25, wherein said metal powder or said metal alloy powder has a percent by weight, the percent by weight of the metal powder or metal alloy powder being greater than or equal to eighty percent and less than or equal to ninety percent.

27. A method of making a liner adapted for use in a charge, comprising the steps of:

blending Bismuth powder with another metal powder thereby producing a result, the blending step including the steps of, further blending a lubricant with the Bismuth powder and said another metal powder and blending graphite with said lubricant; and forming the result into a liner adapted for use in a charge.

28. The method of claim 27, wherein said another metal powder comprises a metal powder or a metal alloy powder having a particle density of over 6 grams/cubic centimeter.

29. The method of claim 28, wherein at least part of said another metal powder is selected from a group consisting of nickel, tin, tungsten, tantalum, zinc, bronze, and depleted uranium.

* * * * *